US007631522B2

(12) United States Patent
Bindocci et al.

(10) Patent No.: US 7,631,522 B2
(45) Date of Patent: Dec. 15, 2009

(54) WASHING MACHINE WITH LOAD SENSOR

(75) Inventors: Sabrina Bindocci, San Mauro Torinese (IT); Angelo Muneretto, Rivolo (IT); Giorgio Carrer, Turin (IT); Paolo Senor, Condove (IT); Marco Bogetto, Moncalieri (IT); Paolo Da Pont, Turin (IT); Giosué Capizzi, Buttigliera Alta (IT)

(73) Assignee: Elbi International S.p.A., Turin (IT)

( * ) Notice: Subject to any disclaimer, the term of this patent is extended or adjusted under 35 U.S.C. 154(b) by 448 days.

(21) Appl. No.: 11/414,416

(22) Filed: May 1, 2006

(65) Prior Publication Data

US 2006/0283211 A1 Dec. 21, 2006

(30) Foreign Application Priority Data

May 2, 2005 (IT) ..... TO2005A0297

(51) Int. Cl.
*D06F 33/02* (2006.01)

(52) U.S. Cl. ..... 68/12.04; 68/12.05; 68/12.21; 68/12.27

(58) Field of Classification Search ..... 68/12.05, 68/12.21, 12.04, 12.27; 200/83 WM
See application file for complete search history.

(56) References Cited

U.S. PATENT DOCUMENTS

| | | | | |
|---|---|---|---|---|
| 3,209,094 | A * | 9/1965 | Bauer | 200/83 P |
| 4,203,462 | A * | 5/1980 | Beller | 137/393 |
| 4,671,116 | A * | 6/1987 | Glennon et al. | 73/728 |
| 5,515,565 | A * | 5/1996 | Maddix et al. | 8/158 |
| 6,336,348 | B1 * | 1/2002 | Lee et al. | 68/12.27 |
| 6,481,246 | B1 * | 11/2002 | Johnson et al. | 68/12.05 |

* cited by examiner

*Primary Examiner*—Joseph L Perrin
(74) *Attorney, Agent, or Firm*—Sughrue Mion, PLLC

(57) ABSTRACT

The washing machine comprises a support structure in which is suspended a washing chamber in which a laundry drum is mounted to be rotatable, and in which a detector is provided, capable of providing electrical signals indicating the level of the washing liquid in the chamber. The detector comprises an inductive transducer including a coil and an associated core, the relative position of which is variable according to the level of the washing liquid such that the inductance of the coil varies accordingly. The inductive transducer is coupled to the laundry drum in such a way that the inductance of the coil is variable also according to the weight of the load contained in the drum.

2 Claims, 2 Drawing Sheets

WASHING MACHINE WITH LOAD SENSOR

BACKGROUND OF THE INVENTION

The present invention relate to washing machines.

More specifically, the invention is aimed at a washing machine comprising a support structure in which is suspended a washing chamber in which a laundry drum is mounted to be rotatable, and in which detector means are provided, capable of providing electrical signals indicating the level of the washing liquid in said chamber, said detector means comprising an inductive transducer including a coil and an associated core, the relative position of which is variable according to the level of the washing liquid, such that the inductance of said coil varies accordingly.

Washing machines of that type have been produced and widely used for years. In such machines, the means for detecting the level of the liquid in the washing chamber typically comprise an inductive pressure transducer coupled to a so-called air trap by means of a small tube. The inductive pressure transducer comprises a rigid casing in which a diaphragm is disposed. When the level of the liquid in the washing chamber exceeds a predetermined level, a column of air is trapped between the air trap and the transducer and, as the liquid level rises, the pressure which the column of air exerts on the diaphragm increases. The diaphragm in turn brings about a corresponding relative displacement of the core with respect to the associated coil. The consequent variation in the inductance of the coil may be detected in various ways. The coil may for example be inserted in an oscillatory circuit, and the variation in its inductance brings about a corresponding variation in the resonant frequency of that circuit.

It is convenient to be able to have available in the washing machine information regarding the load or weight of the laundry introduced into the drum. For this purpose it is known to provide a washing machine with a suitable sensor, generally termed a weight sensor.

The addition of a weight sensor involves an increase in cost, and in complexity, of the washing machine and of the relevant control system.

SUMMARY OF THE INVENTION

It is an aim of the present invention to produce a washing machine of the type defined initially, in which the information relating to the load or weight of the laundry contained in the drum is available at a reduced cost, and without a substantial increase in the complexity of the machine and of its control system.

These and other aims are achieved according to the invention by a washing machine of the type specified above, characterized in that the aforesaid inductive transducer is coupled to the laundry drum in such a way that the inductance of its coil is variable also according to the weight of the load contained in said drum.

BRIEF DESCRIPTION OF THE DRAWINGS

Further characteristics and advantages of the invention will become clear from the following detailed description, provided purely by way of non-limiting example, with reference to the appended drawings, in which.

DETAILED DESCRIPTION OF THE INVENTION

Figure 1:
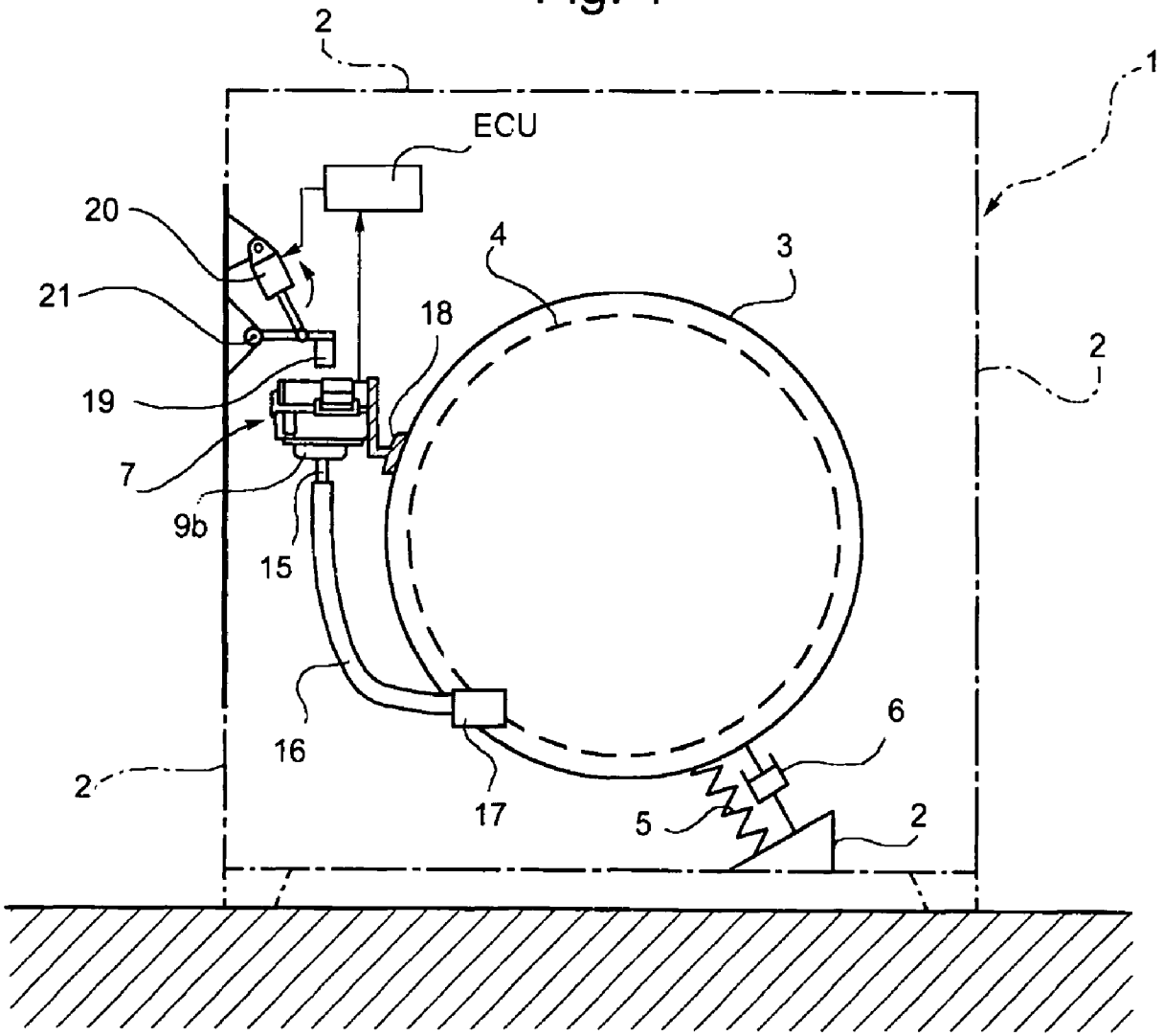
FIG. 1 is a representation of a washing machine according to the present invention.

With reference to the drawings, in FIG. 1 the reference 1 indicates as a whole a washing machine comprising, in a manner known per se, a support structure 2 inside which is suspended a washing chamber 3 of generally cylindrical shape.

In the chamber 3 a laundry drum 4 is mounted to be rotatable.

The machine 1 may be of the front-loading or the top-loading type.

In a manner known per se, and as shown diagrammatically in FIG. 1, the assembly formed by the washing chamber 3 and the laundry drum 4 is suspended within the support structure 2 of the machine by means of resilient devices, for example springs, nominally represented in the diagram of FIG. 1 by a spring indicated by 5, and associated damping means, represented by a damper which is indicated by 6 in the diagram of FIG. 1.

The configuration and arrangement of the resilient suspension means and of the associated resilient damping means are irrelevant for the purposes of the present invention and may correspond to any of the various known solutions.

Associated with the washing chamber 3 is a detector device 7 intended to provide signals indicating the level of the washing liquid in the chamber 3.

The detector device 7 fundamentally comprises an inductive pressure transducer 8 of a type which is known per se. In the exemplary diagrammatic representation of FIG. 2, the inductive pressure transducer 8 comprises a rigid support casing 9, including two bodies 9*a* and 9*b* coupled to each other. Locked between the bodies is the periphery of a resilient diaphragm 10, which, relative to the lower body 9*b*, defines a chamber 11 of variable volume. Associated with the central portion of the diaphragm 10 is a dish-like member 12 connected to a core 13 of ferromagnetic material, for example a ferrite. The core is mounted to be axially movable within a winding or coil 14 carried by the support structure 9.

In a manner which is known per se, the arrangement is such that, in operation, as the air pressure in the chamber 11 varies, the relative axial position of the core 13 with respect to the coil 14 varies, and therefore the inductance of the coil varies accordingly.

The lower body 9*b* has a connector or inlet pipe 15 which is coupled by means of a small flexible tube 16 to a so-called air trap 17 (FIG. 1) associated with the washing chamber 3.

The arrangement is such that when the level of the liquid in the washing chamber 3 reaches and exceeds a predetermined level, the pressure of the air contained between the air trap 17 and the inductive pressure transducer 7 increases, bringing about a variation in the relative position of the core 13 with respect to the coil 14 and a consequent variation in the inductance of the coil.

In the exemplary embodiment illustrated in the drawings, the detector device 7 has its own support structure 9 connected to the washing chamber 3, for example by means of an attachment bracket indicated by 18 in FIG. 1.

Figure 2:
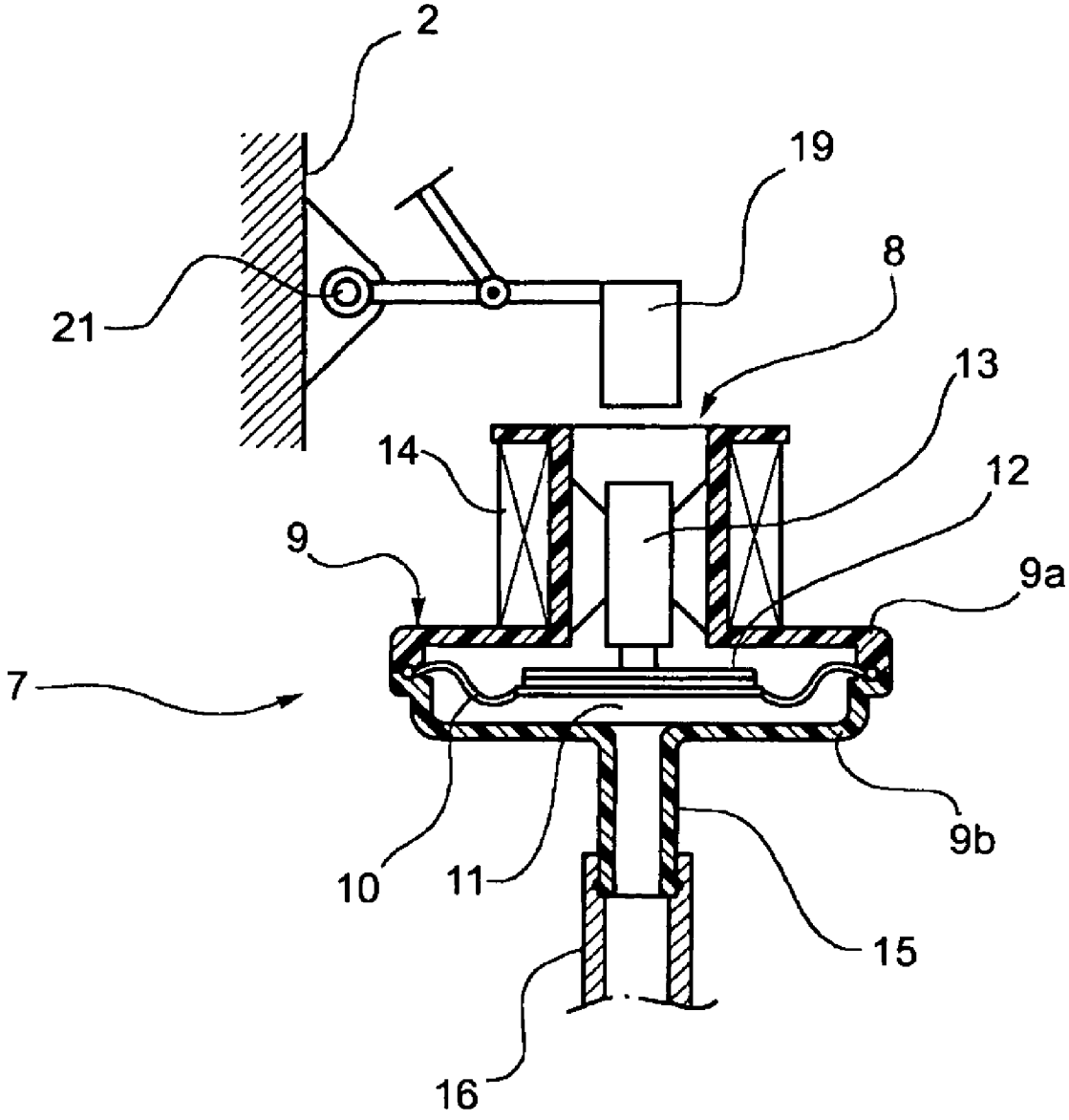
FIG. 2 is a representation, partly in elevation and partly in section, of an inductive transducer and of associated devices for use in a washing machine according to the present invention.

In the embodiment illustrated, connected to the support structure 2 of the machine 1 is a ferromagnetic member, indicated by 19 in FIGS. 1 and 2. The ferromagnetic member is disposed in proximity to the winding 14, preferably in a position axially aligned with the core 13.

The arrangement described above is such that it operates in the following manner.

When the user introduces laundry to be washed into the laundry drum 4, the assembly formed by the washing chamber 3 and by the drum 4 descends under the effect of the load, to a degree which depends on the load. Correspondingly, the distance between the ferromagnetic member 19 and the inductive transducer 8 of the detector for the level of the washing liquid increases. This results in a variation in the inductance exhibited by the winding or coil 14. In this state, a control unit of the machine, ECU in FIG. 1, to which the transducer 8 is connected, interprets the detected variation in the inductance of the winding or coil 14 as fundamentally due to the load or weight of the laundry introduced into the drum 4. In this state, the inductive transducer 8 therefore functions as a load sensor.

Subsequently, when a washing liquid (water, detergent, etc.) is introduced into the washing chamber, therefore in a state of constant load, the variation detected by the ECU unit in the inductance of the winding or coil 14 of the inductive transducer 8 is to be regarded as being substantially due only to the variation of the level of the washing liquid in the chamber 3. In that state the detector device 7 therefore functions primarily as a detector for the level of the washing liquid.

In order to avoid mechanical interference and/or alterations in the signal supplied by the detector 7 when it functions as sensor for the level of the washing liquid, the interaction between the supplementary ferromagnetic member 19 and the detector may be limited only to the phases of measurement of the weight or load of laundry. This may be effected for example by means of an actuator device 20, controllable by the ECU unit and capable of causing displacement of the ferromagnetic member 19 away from the detector 7. In the embodiment illustrated, the ferromagnetic member 19 is mounted to be rotatable about an axis 21 (see also FIG. 2) and the actuator 20 is capable of causing it to pivot about that axis.

The present invention is therefore characterized in that the inductive transducer 8 of the detector 7 is coupled to the laundry drum 4 in such a way that the inductance of its coil 14 is variable also according to the weight of the load contained in the drum 4.

On the other hand, differing from the exemplary embodiment shown in the drawings and described above, the detector 7 could be mounted rigidly on the support structure 2 of the machine, and the ferromagnetic member 19 could be firmly connected to the assembly comprising the washing chamber 3 and the laundry drum 4.

Moreover, the coupling between the inductive transducer 8 of the detector 7 and the washing chamber/laundry drum assembly may not necessarily be of a magnetic type. In an alternative embodiment, the coupling could be of a mechanical type, or such that the variation in position in the washing chamber/laundry drum assembly due to the load is capable of effecting a different initial relative positioning of the core 13 relative to the associated winding or coil 4.

With the principle of the invention remaining unchanged, the embodiments and the details of production may of course be widely varied with respect to what has been described and illustrated purely by way of non-limiting example, without thereby departing from the scope of the invention, as defined in the attached claims.

What is claimed is:

1. A washing machine comprising a support structure in which is suspended a washing chamber in which a laundry drum is mounted to be rotatable, and detector means for providing electrical signals indicating the level of the washing liquid in said chamber, said detector means comprising an inductive transducer including a coil and an associated core, the relative position of which is variable according to the level of the washing liquid in such a way that the inductance of said coil varies accordingly;

said inductive transducer being coupled to the laundry drum so that the inductance of said coil is also variable according to the weight of the load contained in said drum;

wherein the transducer has associated processing and control means for, in at least a first state, correlating the inductance of the coil of the transducer with the weight of the aforesaid load and, in at least a second state, correlating the inductance with the level of the liquid in the washing chamber.

2. A washing machine according to claim 1, wherein said detector means comprise a level detector device connected to the washing chamber.

* * * * *